US006022842A

United States Patent [19]

Owens et al.

[11] Patent Number: 6,022,842

[45] Date of Patent: Feb. 8, 2000

[54] AZEOTROPE-LIKE COMPOSITIONS INCLUDING PERFLUOROBUTYL METHYL ETHER, 1- BROMOPROPANE AND ALCOHOL

[75] Inventors: John G. Owens, Woodbury, Minn.; Hideto Yanome, Kanagawa, Japan

[73] Assignee: 3M Innovative Properties Company, St. Paul, Minn.

[21] Appl. No.: 09/021,904

[22] Filed: Feb. 11, 1998

[51] Int. Cl.[7] ..... C11D 7/26; C11D 7/30; C11D 7/50

[52] U.S. Cl. ..... 510/410; 106/311; 134/42; 510/411

[58] Field of Search ..... 510/410, 411; 252/67; 106/311; 134/42

[56] References Cited

U.S. PATENT DOCUMENTS

| | | | |
|---|---|---|---|
| 2,713,593 | 7/1955 | Brice et al. | 260/535 |
| 3,394,878 | 7/1968 | Eiseman | 252/67 |
| 3,900,372 | 8/1975 | Childs et al. | 204/81 |
| 3,903,012 | 9/1975 | Brandreth | 252/194 |
| 5,023,009 | 6/1991 | Merchant | 252/171 |
| 5,023,010 | 6/1991 | Merchant | 252/171 |
| 5,034,424 | 7/1991 | Wenning et al. | 521/109.1 |
| 5,064,560 | 11/1991 | Merchant | 252/171 |
| 5,091,104 | 2/1992 | Van Der Puy | 252/171 |
| 5,098,595 | 3/1992 | Merchant | 252/171 |
| 5,125,978 | 6/1992 | Flynn et al. | 134/2 |
| 5,137,932 | 8/1992 | Behme et al. | 521/131 |
| 5,211,873 | 5/1993 | Dams et al. | 252/182.24 |
| 5,264,462 | 11/1993 | Hodson et al. | 521/88 |
| 5,273,592 | 12/1993 | Chi Li | 134/40 |
| 5,275,669 | 1/1994 | Van Der Puy et al. | 134/42 |
| 5,466,877 | 11/1995 | Moore | 562/852 |
| 5,484,546 | 1/1996 | Minor et al. | 252/67 |
| 5,718,293 | 2/1998 | Flynn | 169/45 |
| 5,792,277 | 8/1998 | Shubkin et al. | 134/19 |
| 5,814,595 | 9/1998 | Flynn et al. | 510/411 |
| 5,827,446 | 10/1998 | Merchant | 252/67 |
| 5,827,812 | 10/1998 | Flynn | 510/411 |

FOREIGN PATENT DOCUMENTS

| | | |
|---|---|---|
| 0 450 855 A2 | 10/1991 | European Pat. Off. . |
| 2287432 | 7/1976 | France . |
| 1294949 | 5/1969 | Germany . |
| 13 02 054 | 2/1970 | Germany . |
| 6-293686 | 10/1994 | Japan . |
| 7-159821 | 6/1995 | Japan . |
| 8-25995 | 11/1996 | Japan . |
| 8-333292 | 12/1996 | Japan . |
| 2274462 | 7/1994 | United Kingdom . |
| 96/22356 | 7/1996 | WIPO . |
| WO96/22356 | 7/1996 | WIPO . |
| 96/36689 | 11/1996 | WIPO . |
| WO 96/40834 | 12/1996 | WIPO . |
| WO 97/47704 | 12/1997 | WIPO . |
| WO 93/38947 | 8/1999 | WIPO . |

OTHER PUBLICATIONS

1995 American Chemical Society., Predictions of Azeotropes Formed From Fluorinated Ethers, Ethanes, and Propanes. Authors: Gage, C.L.; Kazachki, G. S. Report date: 1992. no month available.

Preparation, Properties and Industrial Applications of Organofluorine Compounds, R. E. Banks, ed., John Wiley and Sons, New York, 1982, pp. 19–43, no month availabel.

P.S. Zurer, "Looming Ban on Production of CFCs, Halons Spurs Switch to Substitutes," *Chemical & Engineering News*, p. 12, Nov. 13, 1993.

Y. Tang, *Atmospheric Fate of Various Fluorocarbons*, M.S. Thesis, Massachusetts Institute of Technology (1993), no month available.

H. Kobler et al., *Justus Liebigs Ann. Chem.*, 1978, p. 1937 (English language Abstract), no month available.

Cooper et al., *Atmos. Environ.*26A, 7, 1331 (1992), no month available.

Intergovernmental Panel, *Climate Change: The IPCC Scientific Assessment*, Cambridge University Press (1990), no month available.

B.N. Ellis, *Cleaning and Contamination of Electronics Components and Assemblies*, Electrochemical Publications Limited, Ayr, Scotland, pp. 182–94 (1986). no month available.

M.C. Sneed and R.C. Brasted, *Comprehensive Inorganic Chemistry*, volume Six (The Alkali Metals), pp. 61–64, D. Van Nostrand Company, Inc., New York 91957).

*Primary Examiner*—Christine Skane
*Attorney, Agent, or Firm*—Kent S. Kokko

[57] ABSTRACT

The invention provides azeotrope-like compositions consisting essentially of $R_fOCH_3$, where $R_f$ is a branched or straight chain perfluoroalkyl group having 4 carbon atoms, 1-bromopropane and an alcohol and cleaning and coating compositions and processes utilizing such compositions

10 Claims, No Drawings

AZEOTROPE-LIKE COMPOSITIONS INCLUDING PERFLUOROBUTYL METHYL ETHER, 1- BROMOPROPANE AND ALCOHOL

FIELD OF THE INVENTION

The invention relates to azeotropes and methods of using azeotropes to clean substrates, deposit coatings and transfer thermal energy.

BACKGROUND

Chlorofluorocarbons (CFCs) and hydrochlorofluorocarbons (HCFCs) have been used in a wide variety of solvent applications such as drying, cleaning (e.g., the removal of flux residues from printed circuit boards), and vapor degreasing. Such materials have also been used in refrigeration and heat transfer processes. While these materials were initially believed to be environmentally-benign, they have now been linked to ozone depletion. According to the Montreal Protocol and its attendant amendments, production and use of CFCs must be discontinued (see, e.g., P. S. Zurer, "Looming Ban on Production of CFCs, Halons Spurs Switch to Substitutes," *Chemical & Engineering News*, page 12, Nov. 15, 1993). The characteristics sought in replacements, in addition to low ozone depletion potential, typically have included boiling point ranges suitable for a variety of solvent cleaning applications, low flammability, and low toxicity. Solvent replacements also should have the ability to dissolve both hydrocarbon-based and fluorocarbon-based soils. Preferably, substitutes will also be low in toxicity, have no flash points (as measured by ASTM D3278-89), have acceptable stability for use in cleaning applications, and have short atmospheric lifetimes and low global warming potentials.

Certain perfluorinated (PFCs) and highly fluorinated hydrofluorocarbon (HFCs) materials have also been evaluated as CFC and HCFC replacements in solvent applications. While these compounds are generally sufficiently chemically stable, nontoxic and nonflammable to be used in solvent applications, PFCs tend to persist in the atmosphere, and PFCs and HFCs are generally less effective than CFCs and HCFCs for dissolving or dispersing hydrocarbon materials. Also, mixtures of PFCs or HFCs with hydrocarbons tend to be better solvents and dispersants for hydrocarbons than PFCs or HFCs alone.

Many azeotropes possess properties that make them useful solvents. For example, azeotropes have a constant boiling point, which avoids boiling temperature drift during processing and use. In addition, when a volume of an azeotrope is used as a solvent, the properties of the solvent remain constant because the composition of the solvent does not change. Azeotropes that are used as solvents also can be recovered conveniently by distillation.

There currently is a need for azeotrope or azeotrope-like compositions that can replace CFC- and HCFC-containing solvents. Preferably these compositions would be nonflammable, have good solvent power, cause no damage to the ozone layer and have a relatively short atmospheric lifetime so that they do not significantly contribute to global warming.

SUMMARY OF THE INVENTION

In one aspect, the invention provides azeotrope-like compositions consisting essentially of hydrofluorocarbon ether, 1-bromopropane and a lower alcohol having 1 to 4 carbon atoms. The hydrofluorocarbon ether is represented by the general formula $R_fOCH_3$, where $R_f$ is a branched or straight chain perfluoroalkyl group having 4 carbon atoms, and the ether may be a single compound or a mixture of the branched and straight chain ether compounds.

While the concentrations of the hydrofluorocarbon ether, 1-bromopropane and alcohol included in the azeotrope-like compositions may vary somewhat from the concentrations found in the azeotrope formed between them and remain a composition within the scope of this invention, the boiling point of the azeotrope-like compositions will be substantially the same as that of its corresponding azeotrope. Preferably, the azeotrope-like compositions boil, at ambient pressure, at temperatures that are within about 1° C. of the temperatures at which their corresponding azeotrope boils at the same pressure.

In another aspect, the invention provides a method of cleaning objects by contacting the object to be cleaned with the azeotrope-like compositions of this invention or the vapor of such compositions until undesirable contaminants or soils on the object are dissolved, dispersed or displaced and rinsed away.

In yet another aspect, the invention also provides a method of coating substrates using the azeotrope-like compositions as solvents or carriers for the coating material. The process comprises the step of applying to at least a portion of at least one surface of a substrate a liquid coating composition comprising: (a) an azeotrope-like composition, and (b) at least one coating material which is soluble or dispersible in the azeotrope-like composition. Preferably, the process further comprises the step of removing the azeotrope-like composition from the liquid coating composition, for example, by evaporation.

The invention also provides coating compositions consisting essentially of an azeotrope-like composition and a coating material which are useful in the aforementioned coating process.

In yet another aspect, the invention provides a method of transferring thermal energy using the azeotrope-like compositions of this invention as heat transfer fluids (e.g., primary or secondary heat transfer media).

DETAILED DESCRIPTION

The azeotrope-like compositions are mixtures of hydrofluorocarbon ether, 1-bromopropane and lower alcohol having about 1 to 4 carbon atoms which, if fractionally distilled, produce a distillate fraction that is an azeotrope of the hydrofluorocarbon ether, 1-bromopropane and the alcohol.

The azeotrope-like compositions boil at temperatures that are essentially the same as the boiling points of its corresponding azeotrope. Preferably, the boiling point of the azeotrope-like compositions at ambient pressure are within about 1° C. of the boiling point of its corresponding azeotrope measured at the same pressure. More preferably, the azeotrope-like compositions will boil at temperatures that are within about 0.5° C. of the boiling points of their corresponding azeotrope measured at the same pressure.

The concentrations of the hydrofluorocarbon ether, 1-bromopropane and alcohol in a particular azeotrope-like composition may vary substantially from the amounts contained in the composition's corresponding azeotrope; however, preferably, the concentrations of hydrofluorocarbon ether, 1-bromopropane and alcohol in an azeotrope-like composition vary no more than about ten percent from the concentrations of such components contained in the azeotrope formed between them at ambient pressure. More preferably, the concentrations are within about five percent of those contained in the azeotrope. Most preferably, the azeotrope-like composition contains essentially the same concentrations of the ether, 1-bromopropane and alcohol as are contained in the azeotrope formed between them at ambient pressure. Where the concentrations of ether, 1-bromopropane and alcohol in an azeotrope-like composition differ from the concentrations contained in the corresponding azeotrope, the preferred compositions contain a concentration of the ether that is in excess of the ether's concentration in the azeotrope. Such compositions are likely to be less flammable than azeotrope-like compositions in which the 1-bromopropane and alcohol are present in a concentration that is in excess of its concentration in the azeotrope. The most preferred azeotrope-like compositions will exhibit no significant change in the solvent power of the compositions over time.

The azeotrope-like compositions of this invention may also contain, in addition to the hydrofluorocarbon ether, 1-bromopropane and alcohol, small amounts of other compounds which do not interfere in the formation of the azeotrope. For example, small amounts of surfactants may be present in the azeotrope-like compositions of the invention to improve the dispersibility or solubility of materials, such as water, soils or coating materials (e.g., perfluoropolyether lubricants and fluoropolymers), in the azeotrope-like composition.

The characteristics of azeotropes are discussed in detail in Merchant, U.S. Pat. No. 5,064,560 (see, in particular, col. 4, lines 7–48).

The hydrofluorocarbon ether useful in the invention can be represented by the following general formula:

$$R_f—O—CH_3 \quad (I)$$

where, in the above formula, $R_f$ is selected from the group consisting of linear or branched perfluoroalkyl groups having about 4 carbon atoms. The ether may be a mixture of ethers having linear or branched perfluoroalkyl $R_f$ groups. For example, perfluorobutyl methyl ether containing about 95 weight percent perfluoro-n-butyl methyl ether and 5 weight percent perfluoroisobutyl methyl ether and perfluorobutyl methyl ether containing about 60 to 80 weight percent perfluoroisobutyl methyl ether and 40 to 20 weight percent perfluoro-n-butyl methyl ether are useful in this invention.

The hydrofluorocarbon ether can be prepared by alkylation of:

$CF_3CF_2CF_2CF_2O^-$, $CF_3CF(CF_3)CF_2O^-$, $C_2F_5C(CF_3)FO^-$, $C(CF_3)_3O^-$ and mixtures thereof. The first three aforementioned perfluoroalkoxides can be prepared by reaction of $CF_3CF_2CF_2C(O)F$, $CF_3CF(CF_3)C(O)F$, and $C_2F_5C(O)CF_3$ and mixtures thereof, with any suitable source of anhydrous fluoride ion such as anhydrous alkali metal fluoride (e.g., potassium fluoride or cesium fluoride) or anhydrous silver fluoride in an anhydrous polar, aprotic solvent in the presence of a quaternary ammonium compound such as "ADOGEN 464" available from the Aldrich Chemical Company. The perfluoroalkoxide, $C(CF_3)_3O^-$, can be prepared by reacting $C(CF_3)_3OH$ with a base such as KOH in an anhydrous polar, aprotic solvent in the presence of a quaternary ammonium compound. General preparative methods for the ethers are also described in French Patent No. 2,287,432 and German Patent No. 1,294,949.

Suitable alkylating agents for use in the preparation include dialkyl sulfates (e.g., dimethyl sulfate), alkyl halides (e.g., methyl iodide), alkyl p-toluenesulfonates (e.g., methyl p-toluenesulfonate), alkyl perfluoroalkanesulfonates (e.g., methyl perfluoromethanesulfonate), and the like. Suitable polar, aprotic solvents include acyclic ethers such as diethyl ether, ethylene glycol dimethyl ether, and diethylene glycol dimethyl ether; carboxylic acid esters such as methyl formate, ethyl formate, methyl acetate, diethyl carbonate, propylene carbonate, and ethylene carbonate; alkyl nitriles such as acetonitrile; alkyl amides such as N,N-dimethylformamide, N,N-diethylformamide, and N-methylpyrrolidone; alkyl sulfoxides such as dimethyl sulfoxide; alkyl sulfones such as dimethylsulfone, tetramethylene sulfone, and other sulfolanes; oxazolidones such as N-methyl-2-oxazolidone; and mixtures thereof.

Perfluorinated acyl fluorides (for use in preparing the hydrofluorocarbon ether) can be prepared by electrochemical fluorination (ECF) of the corresponding hydrocarbon carboxylic acid (or a derivative thereof), using either anhydrous hydrogen fluoride (Simons ECF) or KF.2HF (Philips ECF) as the electrolyte. Perfluorinated acyl fluorides and perfluorinated ketones can also be prepared by dissociation of perfluorinated carboxylic acid esters (which can be prepared from the corresponding hydrocarbon or partially-fluorinated carboxylic acid esters by direct fluorination with fluorine gas). Dissociation can be achieved by contacting the perfluorinated ester with a source of fluoride ion under reacting conditions (see the methods described in U.S. Pat. No. 3,900,372 (Childs) and U.S. Pat. No. 5,466,877 (Moore), the description of which is incorporated herein by reference) or by combining the ester with at least one initiating reagent selected from the group consisting of gaseous, non-hydroxylic nucleophiles; liquid, non-hydroxylic nucleophiles; and mixtures of at least one non-hydroxylic nucleophile (gaseous, liquid, or solid) and at least one solvent which is inert to acylating agents.

Initiating reagents which can be employed in the dissociation are those gaseous or liquid, non-hydroxylic nucleophiles and mixtures of gaseous, liquid, or solid, non-hydroxylic nucleophile(s) and solvent (hereinafter termed "solvent mixtures") which are capable of nucleophilic reaction with perfluorinated esters. The presence of small amounts of hydroxylic nucleophiles can be tolerated. Suitable gaseous or liquid, non-hydroxylic nucleophiles include dialkylamines, trialkylamines, carboxamides, alkyl sulfoxides, amine oxides, oxazolidones, pyridines, and the like, and mixtures thereof. Suitable non-hydroxylic nucleophiles for use in solvent mixtures include such gaseous or liquid, non-hydroxylic nucleophiles, as well as solid, non-hydroxylic nucleophiles, e.g., fluoride, cyanide, cyanate, iodide, chloride, bromide, acetate, mercaptide, alkoxide, thiocyanate, azide, trimethylsilyl difluoride, bisulfite, and bifluoride anions, which can be utilized in the form of alkali metal, ammonium, alkyl-substituted ammonium (mono-, di-, tri-, or tetra-substituted), or quaternary phosphonium salts, and mixtures thereof. Such salts are in general commercially available but, if desired, can be prepared by known methods, e.g., those described by M. C. Sneed and R. C. Brasted in *Comprehensive Inorganic Chemistry*, Volume Six (The Alkali Metals), pages 61–64, D. Van Nostrand Company, Inc., New York (1957), and by H. Kobler et al. in *Justus Liebigs Ann. Chem.,* 1978, 1937. 1,4-diazabicyclo [2.2.2]octane and the like are also suitable solid nucleophiles.

The hydrofluorocarbon ethers used to prepare the azeotrope-like compositions of this invention do not deplete the ozone in the earth's atmosphere and have surprisingly short atmospheric lifetimes thereby minimizing their impact on global warming. Reported in Table 1 is an atmospheric lifetime for the hydrofluorocarbon ether which was calculated using the technique described in Y. Tang, *Atmospheric Fate of Various Fluorocarbons*, M. S. Thesis, Massachusetts Institute of Technology (1993). The results of this calculation are presented under the heading "Atmospheric Lifetime (years)". The atmospheric lifetimes of the hydrofluorocarbon ether and its corresponding hydrofluorocarbon alkane were also calculated using a correlation developed between the highest occupied molecular orbital energy and the known atmospheric lifetimes of hydrofluorocarbons and hydrofluorocarbon ethers that is similar to a correlation described by Cooper et al. in *Atmos. Environ.* 26A, 7, 1331(1992). These values are reported in Table 1 under the heading "Estimated Atmospheric Lifetime." The global warming potential of the hydrofluorocarbon ether was calculated using the equation described in the Intergovernmental Panel's *Climate Change: The IPCC Scientific Assessment*, Cambridge University Press (1994). The results of that calculation are presented in Table 1 under the heading "Global Warming Potential". It is apparent from the data in Table 1 that the hydrofluorocarbon ether has a relatively short estimated atmospheric lifetime and relatively small global warming potential. Surprisingly, the hydrofluorocarbon ether also has a significantly shorter estimated atmospheric lifetime than its corresponding hydrofluorocarbon alkane.

TABLE 1

| Compound | Estimated Atmospheric Lifetime (years) | Atmospheric Lifetime (years) | Global Warming Potential (100 year ITH) |
|---|---|---|---|
| $C_4F_9$—$CH_3$ | 7.0 | — | — |
| $C_4F_9$—O—$CH_3$ | 1.9 | 4.1 | 480 |

The isomer composition of the ether may have some effect on the composition of the azeotrope. However, even in such mixtures, the boiling point of the azeotropes formed between the components are essentially the same.

The alcohols used to prepare the azeotrope-like compositions having from about 1 to 4 carbon atoms. Representative alcohols include methanol, ethanol isopropanol, 1-propanol, 2-butanol and t-butanol.

Preferably, the azeotrope-like compositions are homogeneous. That is, they form a single phase under ambient conditions, i.e., at room temperature and atmospheric pressure.

The azeotrope-like compositions are prepared by mixing the desired amounts of hydrofluorocarbon ether, 1-bromopropane, alcohol and any other minor components such as surfactants together using conventional mixing means.

The cleaning process of the invention can be carried out by contacting a contaminated substrate with one of the azeotrope-like compositions of this invention until the contaminants on the substrate are dissolved, dispersed or displaced in or by the azeotrope-like composition and then removing (for example by rinsing the substrate with fresh, uncontaminated azeotrope-like composition or by removing a substrate immersed in an azeotrope-like composition from the bath and permitting the contaminated azeotrope-like composition to flow off of the substrate) the azeotrope-like composition containing the dissolved, dispersed or displaced contaminant from the substrate. The azeotrope-like composition can be used in either the vapor or the liquid state (or both), and any of the known techniques for "contacting" a substrate can be utilized. For example, the liquid azeotrope-like composition can be sprayed or brushed onto the substrate, the vaporous azeotrope-like composition can be blown across the substrate, or the substrate can be immersed in either a vaporous or a liquid azeotrope-like composition. Elevated temperatures, ultrasonic energy, and/or agitation can be used to facilitate the cleaning. Various different solvent cleaning techniques are described by B. N. Ellis in *Cleaning and Contamination of Electronics Components and Assemblies*, Electrochemical Publications Limited, Ayr, Scotland, pages 182–94 (1986).

Both organic and inorganic substrates can be cleaned by the process of the invention. Representative examples of the substrates include metals; ceramics; glass; polymers such as: polycarbonate, polystyrene and acrylonitrile-butadiene-styrene copolymer; natural fibers (and fabrics derived therefrom) such as: cotton, silk, linen, wool, ramie; fur; leather and suede; synthetic fibers (and fabrics derived therefrom) such as: polyester, rayon, acrylics, nylon, polyolefin, acetates, triacetates and blends thereof; fabrics comprising a blend of natural and synthetic fibers; and composites of the foregoing materials. The process is especially useful in the precision cleaning of electronic components (e.g., circuit boards), optical or magnetic media, and medical devices and medical articles such as syringes, surgical equipment, implantable devices and prostheses.

The cleaning process of the invention can be used to dissolve or remove most contaminants from the surface of a substrate. For example, materials such as light hydrocarbon contaminants; higher molecular weight hydrocarbon contaminants such as mineral oils, greases, cutting and stamping oils and waxes; fluorocarbon contaminants such as perfluoropolyethers, bromotrifluoroethylene oligomers (gyroscope fluids), and chlorotrifluoroethylene oligomers (hydraulic fluids, lubricants); silicone oils and greases; solder fluxes; particulates; and other contaminants encountered in precision, electronic, metal, and medical device cleaning can be removed. The process is particularly useful for the removal of hydrocarbon contaminants (especially, light hydrocarbon oils), fluorocarbon contaminants, particulates, and water (as described in the next paragraph).

To displace or remove water from substrate surfaces, the cleaning process of the invention can be carried out as described in U.S. Pat. No. 5,125,978 (Flynn et al.) by contacting the surface of an article with an azeotrope-like composition which preferably contains a non-ionic fluoroaliphatic surface active agent. The wet article is immersed in the liquid azeotrope-like composition and agitated therein, the displaced water is separated from the azeotrope-like composition, and the resulting water-free article is removed from the liquid azeotrope-like composition. Further description of the process and the articles which can be treated are found in said U.S. Pat. No. 5,125,978 and the process can also be carried out as described in U.S. Pat. No. 3,903,012 (Brandreth).

The azeotrope-like compositions can also be used in coating deposition applications, where the azeotrope-like composition functions as a carrier for a coating material to enable deposition of the material on the surface of a substrate. The invention thus also provides a coating composition comprising the azeotrope-like composition and a process for depositing a coating on a substrate surface using the azeotrope-like composition. The process comprises the step of applying to at least a portion of at least one surface of a substrate a coating of a liquid coating composition comprising (a) an azeotrope-like composition, and (b) at least one coating material which is soluble or dispersible in the azeotrope-like composition. The coating composition can further comprise one or more additives (e.g., surfactants, coloring agents, stabilizers, anti-oxidants, flame retardants, and the like). Preferably, the process further comprises the step of removing the azeotrope-like composition from the deposited coating by, e.g., allowing evaporation (which can be aided by the application of, e.g., heat or vacuum).

The coating materials which can be deposited by the process include pigments, lubricants, stabilizers, adhesives, anti-oxidants, dyes, polymers, pharmaceuticals, release agents, inorganic oxides, and the like, and combinations thereof. Preferred materials include perfluoropolyether, hydrocarbon, and silicone lubricants; amorphous copolymers of tetrafluoroethylene; polytetrafluoroethylene; and combinations thereof. Representative examples of materials suitable for use in the process include titanium dioxide, iron oxides, magnesium oxide, perfluoropolyethers, polysiloxanes, stearic acid, acrylic adhesives, polytetrafluoroethylene, amorphous copolymers of tetrafluoroethylene, and combinations thereof. Any of the substrates described above (for cleaning applications) can be coated via the process of the invention. The process can be particularly useful for coating magnetic hard disks or electrical connectors with perfluoropolyether lubricants or medical devices with silicone lubricants.

To form a coating composition, the components of the composition (i.e., the azeotrope-like composition, the coating material(s), and any additive(s) utilized) can be combined by any conventional mixing technique used for dissolving, dispersing, or emulsifying coating materials, e.g., by mechanical agitation, ultrasonic agitation, manual agitation, and the like. The azeotrope-like composition and the coating material(s) can be combined in any ratio depending upon the desired thickness of the coating, but the coating material(s) preferably constitute from about 0.1 to about 10 weight percent of the coating composition for most coating applications.

The deposition process of the invention can be carried out by applying the coating composition to a substrate by any conventional technique. For example, the composition can be brushed or sprayed (e.g., as an aerosol) onto the substrate, or the substrate can be spin-coated. Preferably, the substrate is coated by immersion in the composition. Immersion can be carried out at any suitable temperature and can be maintained for any convenient length of time. If the substrate is a tubing, such as a catheter, and it is desired to ensure that the composition coats the lumen wall, it may be advantageous to draw the composition into the lumen by the application of reduced pressure.

After a coating is applied to a substrate, the azeotrope-like composition can be removed from the deposited coating by evaporation. If desired, the rate of evaporation can be accelerated by application of reduced pressure or mild heat. The coating can be of any convenient thickness, and, in practice, the thickness will be determined by such factors as the viscosity of the coating material, the temperature at which the coating is applied, and the rate of withdrawal (if immersion is utilized).

Objects and advantages of this invention are further illustrated by the following examples, but the particular materials and amounts thereof recited in these examples, as well as other conditions and details, should not be construed to unduly limit this invention. Unless otherwise stated all amounts are in grams and all percentages are weight percentages.

EXAMPLES

Example 1

The preparation of the perfluorobutyl methyl ether used to prepare of the azeotrope-like compositions of the following Examples, was prepared as follows.

Perfluoroisobutyryl fluoride, a reactant used to make the ether, was prepared by electrochemically fluorinating isobutyric anhydride (>99% pure), in a Simons ECF cell of the type described in U.S. Pat. No. 2,713,593 (Brice et al.) and in *Preparation, Properties and Industrial Applications of Organofluorine Compounds*, R. E. Banks, ed., John Wiley and sons, New York, 1982, pp. 19 to 43. The gaseous products from the Simons cell were cooled to −62° C. (−80° F.) and the resulting phases separated. The upper HF phase was recycled back to the ECF cell and the lower product phase was collected. The resulting perfluorobutyryl fluoride product contained approximately 56 wt. % perfluoroisobutyryl fluoride, 24 wt. % perfluoro-n-butyryl fluoride and 20 wt. % percent perfluorinated, inert products.

The ether was then prepared by charging into a 100 gallon hastelloy reactor: spray-dried potassium fluoride (48 pounds, 375 moles), anhydrous diglyme (307 pounds), Adogen™ 464 (3.4 pounds, 3.2 moles), triethylamine (12 pounds, 53.9 moles) and perfluorobutyryl fluoride product (190 pounds, 319 moles, supra). While stirring at 24° C. (75° F.), dimethyl sulfate (113 pounds, 407 moles) was pumped into the reactor. The reactor was held at 40° C. (104° F.) for approximately two hours then heated to 60° C. (140° F.) and allowed to react overnight.

The reactor was then charged to 20 wt % aqueous potassium hydroxide (123 pounds) to neutralize any unreacted dimethyl sulfate and stirred for 30 minutes at 21° C. (70° F.) at a solution pH greater than 13. Aqueous HF was added to the solution until the pH was 7 to 8, and the product perfluorobutyl methyl ether fraction was distilled from the reaction mixture. The distillate was washed with water to remove methanol, then fractionally distilled to further purify the desired product. The process provided a product that was approximately 65% perfluoroisobutyl methyl ether and 35% perfluoro-n-butyl methyl ether and boiled at about 59° C. at 734.2 torr. The product identity was confirmed by GCMS, $^{1}H$ and $^{19}F$ NMR and IR.

Examples 2 to 7

Preparation and Characterization of the Azeotrope-like Compositions by Distillation. Mixtures of the hydrofluorocarbon ether, 1-bromopropane and alcohol were evaluated to determine the composition of the azeotrope and azeotrope-like compositions. Mixtures of the aforementioned materials were prepared and distilled in a concentric tube distillation column (Model 9333 from Ace Glass, Vineland N.J.). The distillation was allowed to equilibrate at total reflux for at least 60 minutes. In each distillation, six successive distillate samples, each approximately 5 percent by volume of the total liquid charge, were taken while operating the column at a liquid reflux ratio of 20 to 1. The compositions of the distillate samples were then analyzed using an HP-5890 Series II Plus Gas Chromatograph (Hewlett-Packard) with a 30 m HP-5 capillary column (cross-linked 5% phenyl methyl silicone gum stationary phase), a 30 m Stabilwax DA™ column (Alltech Assoc.), a 30 m Carbograph I™ (Alltech Assoc.) or a 30 m NUKOL™ fused silica capillary column (Supelco) and a flame ionization detector. The boiling points of the distillate were measured using a thermocouple which was accurate to about 1° C. The compositional data, boiling points and ambient pressures at which the boiling points were measured are reported in Table 2.

TABLE 2

| Example | Ether Conc. (wt %) | 1-Bromopropane Conc. (wt. %) | Alcohol | Alcohol Conc. (wt. %) | Boiling Point (° C.) | Ambient Pressure (torr) |
|---|---|---|---|---|---|---|
| 2 | 73.8 | 18.6 ± 0.2 | Methanol | 7.6 ± 0.2 | 44.9 | 746.0 |
| 3 | 74.8 | 20.2 ± 0.8 | Ethanol | 5.0 ± 0.06 | 50.4 | 745.3 |
| 4 | 74.9 | 21.0 ± 0.12 | Isopropanol | 4.1 ± 0.12 | 51.8 | 738 |
| 5 | 76.7 | 21.3 ± 0.6 | 1-Propanol | 2.0 ± 0.12 | 52.6 | 736 |
| 6 | 76.8 | 22.0 ± 0.45 | 2-Butanol | 1.2 ± 0.12 | 53.0 | 736 |
| 7 | 74.7 | 22.8 ± 0.42 | t-Butanol | 2.5 ± 0.33 | 53.1 | 738 |

Examples 8–13

A number of the azeotropes were tested for their ability to dissolve hydrocarbons of increasing molecular weight according to a procedure similar to that described in U.S. Pat. No. 5,275,669 (Van Der Puy et al.) The data presented in Table 3 was obtained by determining the largest normal hydrocarbon alkane which was soluble in a particular azeotrope at a level of 50 volume percent. The hydrocarbon solubilities in the azeotropes were measured at both room temperature and the boiling points of the azeotropes. The data is reported in Table 3. The numbers in Table 3 under the headings "Hydrocarbon @ RT" and "Hydrocarbon @ BP" correspond to the number of carbon atoms in the largest hydrocarbon n-alkane that was soluble in each of the azeotropes at room temperature and at the boiling point of the azeotrope, respectively.

The data in Table 3 shows that hydrocarbon alkanes are very soluble in the azeotrope-like compositions of this invention, and so the azeotrope-like compositions are excellent solvents for the cleaning process of this invention. These compositions will also be effective as solvents for depositing hydrocarbon coatings, e.g., coatings of lubricant, onto substrate surfaces.

TABLE 3

| Ex. | Azeotropic Composition | Hydrocarbon @ RT (# carbon atoms) | Hydrocarbon @ BP (# carbon atoms) |
|---|---|---|---|
| 8 | Composition of Example 2 | 12 | 15 |
| 9 | Composition of Example 3 | 12 | 16 |
| 10 | Composition of Example 4 | 12 | 15 |
| 11 | Composition of Example 5 | 12 | 15 |
| 12 | Composition of Example 6 | 12 | 15 |
| 13 | Composition of Example 7 | 12 | 15 |

Various modifications and alterations of this invention will be apparent to those skilled in the art without departing from the scope and spirit of this invention.

I claim:

1. An azeotrope-like composition including perfluorobutyl methyl ether, which ether consists essentially of perfluoro-n-butyl methyl ether, perfluoroisobutyl methyl ether, or mixtures thereof, 1-bromopropane and alcohol wherein the azeotrope-like composition is selected from the group consisting of:

(i) compositions consisting essentially of the ether, 1-bromopropane and methanol, which when fractionally distilled, produces a distillate fraction that is an azeotrope consisting essentially of about 73.8 weight percent of the ether, and about 18.6 weight percent of the 1-bromopropane and about 7.6 weight percent of the methanol, the azeotrope boiling at about 44.9° C. at about 746 torr;

(ii) compositions consisting essentially of the ether, 1-bromopropane and ethanol which, when fractionally distilled, produce a distillate fraction that is an azeotrope consisting essentially of about 74.8 weight percent of the ether and about 20.2 weight percent of the 1-bromopropane and about 5.0 weight percent of the ethanol, the azeotrope boiling at about 50.4° C. at about 745.3 torr;

(iii) compositions consisting essentially of the ether, 1-bromopropane and isopropanol which, when fractionally distilled, produce a distillate fraction that is an azeotrope consisting essentially of about 74.9 weight percent of the ether, about 21.0 weight percent of the 1-bromopropane and about 4.1 weight percent of the isopropanol, the azeotrope boiling at about 51.8° C. at about 738 torr;

(iv) compositions consisting essentially of the ether, 1-bromopropane and 1-propanol which, when fractionally distilled, produce a distillate fraction that is an azeotrope consisting essentially of about 76.7 weight percent of the ether, about 21.3 weight percent of the 1-bromopropane and about 2.0 weight percent of the 1-propanol, the azeotrope boiling at about 52.6° C. at about 736 torr;

(v) compositions consisting essentially of the ether, 1-bromopropane and 2-butanol which, when fractionally distilled, produce a distillate fraction that is an azeotrope consisting essentially of about 76.8 weight percent of the ether, about 22.0 weight percent of the 1-bromopropane and about 1.2 weight percent of the 2-butanol, the azeotrope boiling at about 53.0° C. at about 736 torr; and (vi) compositions consisting essentially of the ether, 1-bromopropane and t-butanol which, when fractionally distilled, produce a distillate fraction that is an azeotrope consisting essentially of about 74.7 weight percent of the ether, about 22.8 weight percent of the 1-bromopropane and about 2.5 weight percent of the t-butanol, the azeotrope boiling at about 53.1° C. at about 738 torr;

wherein the concentrations of the ether, 1-bromopropane and the alcohol in the azeotrope-like composition differ from the concentrations of such components in the corresponding azeotrope by no more than ten percent.

2. A process for depositing a coating on a substrate surface comprising the step of applying to at least a portion of at least one surface of the substrate a liquid coating composition comprising:

(A) an azeotrope-like composition according to claim 1; and (B) at least one coating material which is soluble or dispersible in the azeotrope-like composition.

3. A process for removing contaminants from the surface of a substrate comprising the step of contacting the substrate with one or more of the azeotrope-like compositions according to claim 1 until the contaminants are dissolved, dispersed or displaced in or by the azeotrope-like composition, and removing the azeotrope-like composition containing the dissolved, dispersed or displaced contaminants from the surface of the substrate.

4. An azeotrope-like composition according to 1 wherein the concentrations of the ether, 1-bromopropane and alcohol in the azeotrope-like composition differ from the concentrations of such components in the corresponding azeotrope by no more than five percent.

5. A process for depositing a coating on a substrate surface comprising the step of applying to at least a portion of at least one surface of the substrate a liquid coating composition comprising:

(A) an azeotrope-like composition according to claim 4; and (B) at least one coating material which is soluble or dispersible in the azeotrope-like composition.

6. A process for removing contaminants from the surface of a substrate comprising the step of contacting the substrate with one or more of the azeotrope-like compositions according to claim 4 until the contaminants are dissolved, dispersed or displaced in or by the azeotrope-like composition, and removing the azeotrope-like composition containing the dissolved, dispersed or displaced contaminants from the surface of the substrate.

7. An azeotrope-like composition according to claim 1 wherein the composition is an azeotrope.

8. A process for depositing a coating on a substrate surface comprising the step of applying to at least a portion of at least one surface of the substrate a liquid coating composition comprising:

(A) an azeotrope-like composition according to claim 7; and (B) at least one coating material which is soluble or dispersible in the azeotrope-like composition.

9. A process for removing contaminants from the surface of a substrate comprising the step of contacting the substrate with one or more of the azeotrope-like compositions according to claim 7 until the contaminants are dissolved, dispersed or displaced in or by the azeotrope-like composition, and removing the azeotrope-like composition containing the dissolved, dispersed or displaced contaminants from the surface of the substrate.

10. A composition according to claim 7 wherein the azeotrope-like composition further comprises a surfactant.

* * * * *